US005345621A

United States Patent [19]

Livingston

[11] Patent Number: 5,345,621

[45] Date of Patent: Sep. 13, 1994

[54] METHOD OF INSULATING A SPA USING A FLEXIBLE INSULATION BLANKET

[75] Inventor: David R. Livingston, Williamsport, Pa.

[73] Assignee: Plastic Development Corporation - PDC, Williamsport, Pa.

[21] Appl. No.: 62,225

[22] Filed: May 18, 1993

[51] Int. Cl.[5] ..... E03C 1/02

[52] U.S. Cl. ..... 4/541.1; 4/545; 4/584

[58] Field of Search ..... 4/545, 541.1, 498, 503, 4/580, 493, 506, 534, 584; 383/110; 165/135; 126/350 D, 615, 1 F, 350 R, 374; 137/375; 122/494

[56] References Cited

U.S. PATENT DOCUMENTS

| | | | |
|---|---|---|---|
| 2,602,935 | 7/1952 | Phillips | 4/584 |
| 3,981,689 | 9/1976 | Trelease | 165/135 |
| 4,137,575 | 2/1979 | Klaffke et al. | 4/498 |
| 4,290,154 | 9/1981 | Benjamin | 4/584 |
| 4,359,084 | 11/1982 | Geverath et al. | 165/135 |
| 4,426,995 | 1/1984 | Wilson | 4/493 |
| 4,986,343 | 1/1991 | Sing | 165/135 |
| 5,022,101 | 6/1991 | Gosselin et al. | 4/498 |
| 5,092,951 | 3/1992 | Popovich et al. | 4/541.1 |

FOREIGN PATENT DOCUMENTS

| | | | |
|---|---|---|---|
| 54-11186 | 1/1979 | Japan | 4/580 |
| 4105619 | 4/1992 | Japan | 4/584 |

*Primary Examiner*—Henry J. Recla

*Assistant Examiner*—Charles R. Eloshway

*Attorney, Agent, or Firm*—Sughrue, Mion, Zinn, Macpeak & Seas

[57] ABSTRACT

A portable type spa is insulated by a sequence of steps involving initially the preparation of an insulation blanket having a metal foil heat reflective surface on one side with orthogonal dimensions of the blanket sized larger than the orthogonal dimensions of the spa shell. The spa shell is placed on top of the insulation blanket in a preferred method, with the metal foil heat reflective surface facing the exterior of the spa shell. The spa shell foot well is leveled by shims placed between the bottom of the spa shell and the underlying support surface such as a floor. The periphery of the insulation blanket is preferably sandwiched between the underside of a spa rim and a top edge of wood skirt panels surrounding the exterior of the spa shell. The insulation blanket forms a loose bag about the exterior of the spa shell and about plumbing connections on the exterior of the spa shell including warm water circulating tubing projecting outwardly of the spa shell exterior surface. The blanket is locally slit in the vicinity of the projecting tubing to permit passage of the tubing through the blanket and the slits are sealed by taping the tubing about the projecting tubing. Alternatively, the loose bag insulation blanket is fixedly mounted to the interior surface of the wood skirt panels below the top edge of those panels just beneath the connection between the top edge of the skirt panels and the rim of the spa shell.

12 Claims, 3 Drawing Sheets

METHOD OF INSULATING A SPA USING A FLEXIBLE INSULATION BLANKET

This invention relates to spas or hot tubs, and more particularly to a method of insulating a spa set up on site, or at the factory, utilizing a flexible insulation blanket which loosely completely surrounds the exterior of the spa shell, including the plumbing connections and to a insulated spa created thereby.

BACKGROUND OF THE INVENTION

Spas and hot tubs are highly popular and modern home construction often incorporates a hot tub or spa, within the home or exterior of the same and physically mounted on or into a deck or the like. The water within the spa shell is continuously circulated during use, being removed from the interior of the spa shell, subject to reheating and aeration and injected back into the interior of the spa shell. The users of spas and hot tubs desire the water temperature to be relatively high for its therapeutic effect. Heat loss from the water is excessive and attempts have been made to reduce such heat loss. Typically, a thermal insulation spa hard cover overlies the upwardly open spa shell during periods of non-use. The spa shell itself is supported or surrounded by a vertical perimeter skirt panel, with the upper edge of the skirt panel underlying the rim of the spa shell. In the past, a thermal insulation material such as polyurethane has been sprayed onto the exterior surface of the spa shell to reduce heat loss by convection through the spa shell to the exterior. Such urethane coatings, however, have no effect on heat loss in the plumbing connections, i.e. the pipes or tubing associated with the spa support equipment such as pumps, heaters and circulating the water from the interior of the spa shell to the spa support equipment and returning the same for injection interiorly of the spa shell through fittings projecting through the spa shell and opening to the interior of the spa. Thermal insulation of bathtubs, spas and hot tubs has been attempted in the past years. Early bathtubs were formed of cast iron. The heat of water drawn into a cast iron tub of 500 pounds weight may be absorbed by a cold iron tub so fast that before the normal bath is completed, water temperature drops from a comfortable to an uncomfortable temperature. Thus, insulation of the exterior of such a tub is of little value in conserving the heat of the water. The more modern bathtubs formed of steel, enameled steel, plastic have significantly reduced heat convection losses.

U.S. Pat. No. 2,602,935 to H. K. Phillips, issued Jul. 15, 1952 and entitled "INSULATING APPARATUS FOR BATHTUBS" teaches the use of a wire basket configured to the exterior of an upwardly open elongated U-shaped cross-section bathtub supported by hooks depending from the rim of the bathtub and supporting a fibrous insulation material mat in the space between the basket and the outer surface of the tub, with the insulation material held against the outer surface of the tub.

The more modern approach is to spray onto the outer surface of the tub a polyurethane foam insulation coating. Unfortunately, such spray coating covers everything including the water or air and water injection nozzles mounted within the spa shell and coupled to the spa support equipment by typical plumbing connections involving tubing, hoses or the like, particularly for spas and hot tubs. Such spray insulation coatings render repair of leaks, in defective spa support equipment and plumbing connections difficult, if not impossible. Further, such insulation on the exterior surface of the tub, spa shell or hot tub shell has no effect on heat losses emanating directly from the plumbing connections or pipes exterior of the shell itself.

U.S. Pat. No. 4,316,294 to Baldwin, issued Feb. 23, 1982 and entitled "BATHTUB" teaches the formation of a bathtub of a unitary body having an insulated interior formed of wood or pressed wood fibers bonded together by a suitable adhesive with an exposed exterior covering of fiberglass, plastic or the like, and with that exterior covering defining internally a well adapted to comfortably receive the body of the person while considerably reducing the dissipation of heat from the water within the well and which tends to escape by radiation through the body and by radiation and convection outwardly of the bathtub body.

Such construction, while adequate for bathtubs and while providing significant thermal insulation capability, is inapplicable to spas and hot tubs, since all of the plumbing connections are embedded within the wood or pressed wood adhesively bonded fibers.

U.S. Pat. No. 4,357,721 to Newburger, issued Nov. 9, 1982 and entitled "BATHING ASSEMBLY", illustrates the limited use of flexible plastic sheet material in the bathtub field. In this patent, a flexible plastic sheet liner constitutes the interior of the tub. The liner is housed within a cabinet and the cabinet is collapsed beneath a standing sink during non-use of the bathtub. The cabinet structure is expanded to place the flexible plastic film liner into an upwardly open position to function as a bathtub interior wall. The bathing assembly is employed in a hospital or the like where the liner is changed for each patient using the same to prevent a patient from contacting disease from a prior user of the bathing assembly.

U.S. Pat. No. 4,858,254 to Popovich et al., issued Aug. 22, 1989 and entitled "TUB APPARATUS", teaches a tub manufactured from multiple layers of thin plastic films. The laminate structures include foam plastic sheets wound in a spiral about a tub axis to form multiple layers. A tensile liner bonded to the tub wall inner side resists outward expansion in response to loading exerted by liquid filling the tub interior or well. The thermal insulation is effected by a non-stretchable flexible liner, which includes a layer of polyethylene foam bonded to interwoven strips and also to the wall inner side.

The patents to Newburger and Popovich et al. evidence limited use of thin, flexible plastic film material in the construction of tubs, spas and hot tubs.

It is a principal object of the present invention to insulate a spa on site or in the factory to minimize heat loss from the spa by attaching loosely a blanket of thermal insulation material positioned between the outside of the spa shell and the inside of a peripheral wood skirt of panels surrounding the exterior of the spa and extending vertically beneath the rim of the spa shell to the wood skirt panels, to enclose the spa plumbing and to create a dead air space, which effectively reflects heat loss from the interior of the spa shell and from the plumbing back into the well within the spa shell, which permits access to and ready repair of the spa shell or the spa plumbing through the blanket while permitting re-positioning of the blanket after repair of the spa.

DESCRIPTION OF THE PREFERRED EMBODIMENTS

Figure 1:
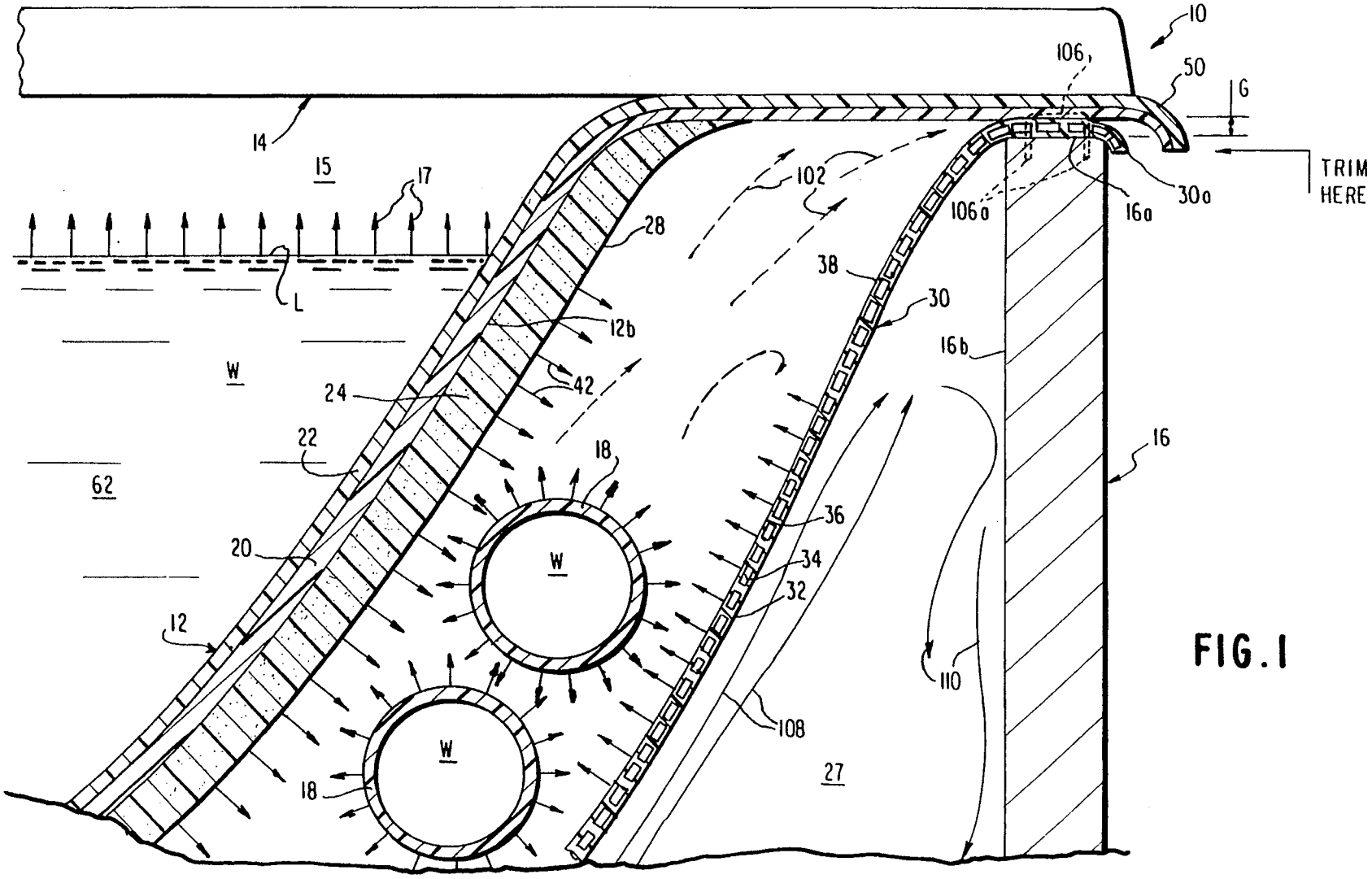
FIG. 1 is a sectional view through a portion of a spa or hot tub illustrating the method of insulating the spa or hot tub by use of a flexible insulation blanket and to an insulated spa or hot tub created thereby, forming a preferred embodiment of the invention.
Figure 2:
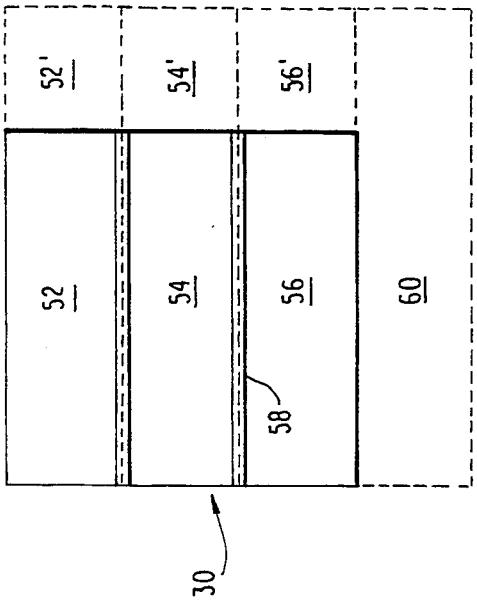
FIG. 2 is a top plan view of an insulation blanket preassembled prior to attachment to the exterior of the spa shell in accordance with the invention of FIG. 1.
Figure 3:
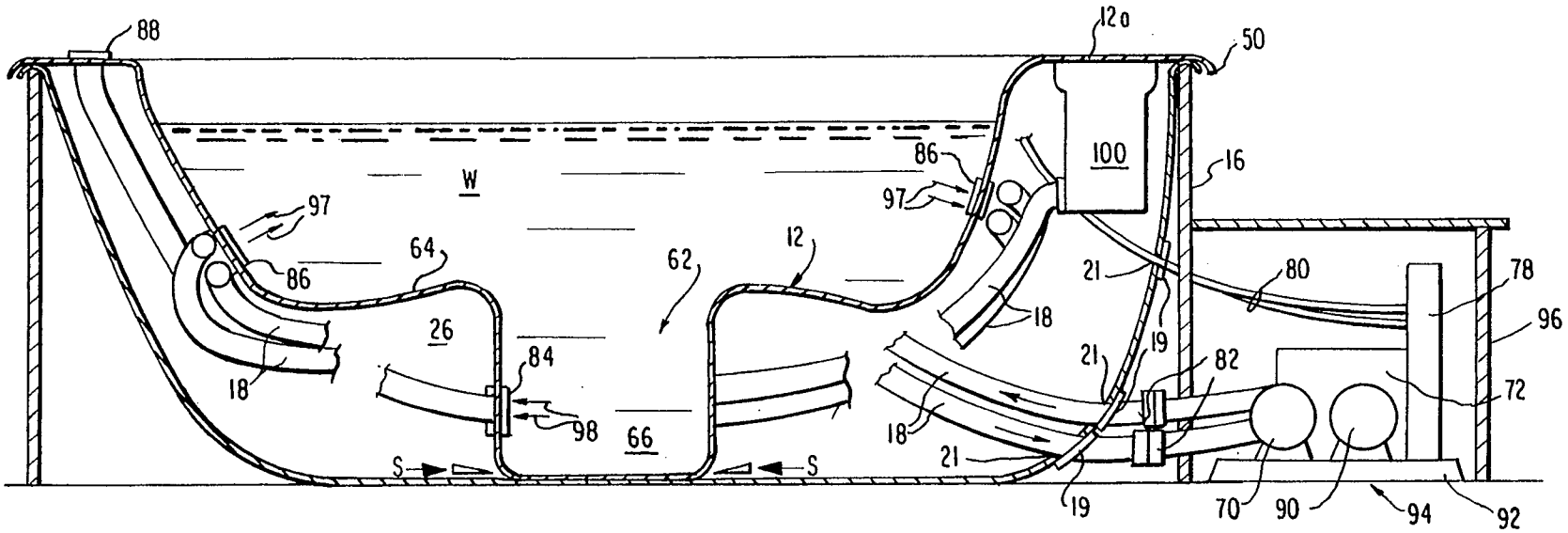
FIG. 3 is a transverse vertical sectional view through the insulated spa of FIG. 1 upon complete assembly of the spa, with the spa insulation blanket mounted loosely about the spa shell and spaced therefrom to form a large dead air space.

Referring to FIGS. 1–3, a preferred embodiment of the invention is illustrated showing the steps in the method of insulating a spa or hot tub by use of a flexible insulation blanket loosely mounted to the exterior of the spa shell and the resulting spa created thereby.

The spa indicated generally at 10 consists of three major components, a fiberglass reinforced molded resin spa shell indicated at 12, a spa hard cover indicated generally at 14, also preferably formed of rigid polyurethane foam panels covered with vinyl cloth material, and a non-load bearing wood skirt or wall panel 16, which may extend about the full outer periphery of the spa shell 12. Preferably, the wall panel 16 is non-load bearing and other frame members or support members are employed for fixedly mounting the spa shell 12 and maintaining it in an upwardly open, upright position in accordance with the drawing figures. Alternatively, the spa 10 may be mounted within a hole within a deck, floor or the like, with a horizontal outwardly flared rim 12*a* overlying the floor or deck at the perimeter of the hole therein, receiving the spa shell 12. The spa hard cover 14 may be constructed of rigid polyurethane foam panels enclosed within a sewn vinyl cloth cover material known as "naugahyde" and providing adequate thermal insulation capability to prevent heat from radiating outwardly of the spa hard cover when in place on the spa shell 12 as shown in FIG. 1. Such spa hard cover is lifted from the spa 10 during use of the same. Typically, water W at approximately 98° F. is maintained interiorly of the spa shell 12 to a water level L somewhat below the height of rim 12*a* of the spa shell. As such, there is a dead air space 15 formed within the interior of the spa shell and with heat radiating from the water W in the direction of the spa hard cover 14.

Conventionally, the spa shell 12 is formed of a major thickness layer 20 of fiberglass reinforced molded resin by chop gun application followed by hand rolling and acting as a backing for an outer layer of acrylic or other spa surface material 22, which may conventionally be a gel coat, typical of fiberglass reinforced molded products. In the illustrated embodiment, a urethane foam insulation layer 24 is applied to the exterior surface 12*b* of the spa shell. The arrows 42, FIG. 1, represent heat loss of heat conducted from the water W to the exterior of the spa shell 12 and through the urethane foam insulation layer 24. FIG. 1 illustrates the tubes, pipes or hoses 18 through which the warm water circulates in passing into and out of the interior of the spa shell and to the pump 70, FIG. 3. Mounted to an underlying support 92 or pad adjacent to the pump 70 is a blower 90. Behind the pump and blower, FIG. 3, is a heater 72, and to the side of the blower 90 and heater 72 is a control panel 78. In the illustrated embodiment, air lines 80 are led to the control panel, whereby control is effected by switches which are actuated by compressed air. A pair of PVC pipes 18 extend between the spa support equipment indicated generally at 94, exterior of the spa proper and within a cabinet 96, and function as suction and discharge lines for pump 70 for circulating water from the well 62 of the spa shell to the heater 72 for reheating of the water, injecting reheated water and air drawn in through the air control inlet 88 through injection nozzles 86 into the interior of the spa shell via PVC tubes or pipes 18. An inlet fitting 84 within a deepened foot well 66 of the spa shell permits the water W within the spa shell to recirculate through the spa support equipment 94. An air inlet fitting 88 within rim 12*a* of the spa shell to the left, FIG. 3, functions as a control for the amount of air that is drawn in and mixed with the water stream at injection nozzle 86 (also known as jets). The optional blower accessory 90 serves to deliver air under pressure to air channels constructed as an integral part of the fiberglass reinforced resin layer 20. Air is admitted into the water through multiple holes drilled through the spa shell 12 and into the air channel. This air system is completely independent of the air controls 88 which supply air to the injection nozzles 86.

It should be appreciated that the circulated water is preferably filtered prior to its being heated by heater 72 and returned to the interior of the spa shell. A filter 100 is mounted to the exterior of the spa shell, in the example beneath the rim 12*a*, and connects via the PVC tubing 18 to the inlet fitting 84 so that the water is prefiltered prior to being circulated through the heater 72. Alternatively, the water may be filtered at discharge side of the heater 72.

The discussion above highlights the necessity for significant spa support equipment integrated to the spa shell, most within the spa support equipment cabinet 96, as well as extensive lengths of tubing for effecting recirculation, filtering, reheating and aeration of the water. The hot water flows through that equipment exterior of the spa shell under ordinary conditions, resulting in significant heat loss. This increases the energy required by heater 72 to maintain a desired temperature of the water within the well 62 of the spa shell, preferably at approximately 98° F. Further, from reference to FIG. 1, it may be appreciated that in the absence of the insulation blanket 30, which is a key aspect of the present invention due to the escape of heat from the well 62 of the spa shell 12 through the urethane foam insulation layer 24 and from the interior of the PVC tubing 18, there are created air currents along the outside of the foam insulation and in the direction of the top of the space between the urethane foam insulation layer 24 and the wood wall or skirt panel 16. Such air currents 102 absent the incorporation of the insulation blanket indicated generally at 30, FIG. 1, result in an escape of the heated air through a small gap G between the upper edge 16*a* of the skirt panel 16 and the urethane foam insulation free portion of the spa shell, i.e. rim 12*a*. The gap G typically exists between these two members and flows beneath the lip 50 at the outer periphery of the spa shell 12. Such air currents 102 which exist along the outside of the foam insulation and across the pipes 18 containing warm water, which constantly remove heat from these surfaces and transport it to the skirt wall 16 or to the outside through leakage between the skirt and the spa shell 12. In addition to convection loss, there is direct radiation from the warm insulation surface 28 of the urethane foam insulation layer 24 and the uninsulated pipe surfaces such as PVC tubes 18 to the inside of the skirt 16, where it is lost by convection to the outside atmosphere. With the outside atmosphere being normally at ambient temperature (with the spa or hot tub exterior of a house or other building structure), significant heat losses result by convection and radiation and constitute a problem solved by the present invention.

In a preferred embodiment of the invention, as shown in FIGS. 1–3, the insulation blanket 30 is a multiple layer polyethylene film assembly made up of full size sheets of flexible polyethylene plastic sheet material, for example 5/16 inch in nominal thickness. Between top and bottom layers of flexible polyethylene, as at 32, 36, FIG. 1, there exists a series of dead air spaces or pockets 34 formed by line sealing of the top and bottom plastic sheets together along intersecting lines or spaced circles. The flexible insulation blanket 30 may for instance be constituted by conventional multi-layer plastic film bubble pack material. However, in the illustrated embodiment, the top or inner side of the insulation blanket is provided with aluminum or like reflective metal foil finish on the exterior surface facing the urethane foam insulated spa shell 12. The bottom layer 32 preferably has a white finish on its exterior surface facing the wood wall or skirt panel 16. The foil finish side of the insulation blanket as at 38 is placed so as to face the spa shell to reflect radiant heat back towards the warm water within PVC tubes 18 or the like and that at W within the well 62 of the spa shell 12.

In most cases, particularly for large spas or hot tubs, the blanket of insulation material can be installed to the exterior surface of the spa shell and to the exterior of the major length of the hot water carrying tubing or piping, and to the left of pipe connectors 82, FIG. 3. The pipe connectors or couplers 82 permit detaching of the PVC tubing 18 proximate to the spa shell 12 from that tubing associated with the spa support equipment 94 within cabinet 96. As such, only minimal slitting is necessary to the insulation blanket limited to a length capable of permitting the tubes or plumbing connections thereof to pass therethrough after attachment of the insulation blanket to the spa shell 12. Thus, the blanket is positioned between the outside of the spa shell 12 and the inside of the wood wall or skirt panel 16, underneath the spa. Since the insulation blanket 30 encloses most of the spa plumbing, the blanket creates a dead air space which surrounds the entire area under the spa 10. The additional insulation, using the method of this invention, constitutes a significant improvement in heat loss reduction over present systems in the art, where insulating foam is applied by spraying, or by adhesive application of insulation bats or the like directly to the outside of the shell only and where the plumbing connections are devoid of insulation. Insulation may be effected for a portable or "knock down" spa, which is set up on site, or alternatively the insulation blanket may be secured about its periphery under the spa rim for spas or hot tubs sold as a "one piece" unit. In any case, the methods of installation are similar and require the creation of a basic insulation blanket assembly as seen in FIG. 2. For a typical spa, such as that illustrated in the drawings, a blanket is formed of a prefabricated flexible multi-layer polyethylene plastic sheet laminate structure which, as indicated, may be 5/16 inch in nominal thickness, including the dead air pockets 34 between the inside and outside flexible polyethylene film layers 32, 36. The pockets 34 may be of circular form, or may be rectangular, depending upon the line seals effected between the outside layers 32, 36.

Typically, such material may come in 3 foot or 4 foot widths, and a plurality of strips of such flexible polyethylene plastic sheet material are cut to length and positioned side-by-side as per FIG. 2, with the aluminum foil side 38 up. Preferably, a blanket is formed which is 4 feet wider in each direction than that of the spa to provide a loose covering of the plumbing connections and the bottom of the spa shell over the complete spa shell exterior surface, including a portion of rim **12*a*. The three strips 52, 54 and 56 in the illustrated embodiment are taped together along the lengthwise direction of the foil sides 38, using a foil tape, supplied with the material. The spas, while conventionally being of square form or circular form, may be elongated, in which case the lengths 52, 54 and 56 may be extended as shown in dotted lines at 52', 54' and 56', respectively. For a larger square or larger diameter round spa, it may be necessary to add an extra sheet 60 which, for instance, may be 16 feet long, i.e., the same length as that of strips 52, 54, 56 with extended lengths 52', 54' and 56'. While the flexible plastic insulation blanket 30 is preferably formed in the manner of the illustrated embodiment, obviously such insulation blanket 30 may be of modified form and may be devoid of the dead air pockets 34**, that is other than of "bubble pack" construction.

In the illustrated embodiments of FIGS. 1–3, the assembled blanket in accordance with FIG. 2 is placed on the foil side up in the area where the spa 10 is to be located. The spa shell is placed in the center of the insulation blanket as per FIG. 3, and the blanket is wrapped up around all sides of the spa, completely enclosing all plumbing 18 and filter units. Shims S may be provided between the bottom of the spa shell and the floor to level the spa. The edges of the blanket 30, FIG. 2, are tucked into the spa shell 12 to hold the blanket 30 in place until the skirt is installed. The skirt panels 16, which number four for a square or rectangular spa, are installed one at a time by placing the upper edge or top **16*a* of the skirt panel 16 under the spa rim 12*a* and sliding the bottom or lower edge 16*b* towards the spa shell 12 until the panel 16 is vertical. As such, the insulation blanket 30 will be captured between the top 16*a* of the skirt panel and the underside of the spa rim 12*a*. The excess insulation material, which lies above the rim, should then be pulled back down under the spa shell and adjusted so that there is a minimum amount left to trim off, with excess blanket material interiorly within the dead air space 26 created by such assembly. It is to be noted that the insulation blanket 30 in passing between the gap G seals off any area, permitting the escape by convection of heat from the dead air space 26. There is no need for the insulation blanket 30 to be drawn tight around the spa shell and plumbing. The excess material allows the skirt panel to be removed in the future for servicing of the filter, as well as plumbing connections between the PVC tubing, and the intake fitting or fittings 84 and the jet nozzles 86, filter or the like. This excess blanket material permits the pulling of more insulation material out from the dead air space 26 when the skirt panels 16 are reinstalled and to trim off the excess material. The trimmed edge is shown at 30***a*, FIG. 1, with the headed arrow labeled "TRIM HERE", identifying the line of cut of the pulled out portion of the insulation blanket 30, either at the time of initial installation or reinstallation after repair or maintenance of the spa equipment internally of the skirt panel 16. The other skirt panels 16 are installed with a similar procedure and the skirt panels are fastened together at their abutting corners. It is after the completion of the assembly of the skirt panels 16 that a small amount of insulation sticking out from under the spa rim 12*a* at lip 50 is trimmed off by using a sharp knife or like implement. One should be careful not to cut into the wood skirt when trimming. Either prior to or subsequent to trimming of the insulation sticking out from under the spa rim, the insulation blanket 30 can be slit at locations where plumbing connections must pass such as in the area of tube couplings 82. Typically, there are between three and five hose or pipe connections, depending upon which support equipment pack is employed for the spa 10. The tubes 18 or hoses are brought through the insulation blanket at a convenient place, and the blanket is then taped at 19 around the hoses, closing off a slit 21 using a portion of the foil tape supplied. The control hoses such as air lines 80 may be brought through the insulation blanket 30 in a similar manner. It is important that any holes or slits 21 in the blanket where the hoses come through be sealed up as well as possible with foil tape 19 or equivalent, since this maintains the integrity of the dead air space 20 between the insulation blanket 30 and the spa shell 12.

While the preferred fixing of the outer periphery of the insulation blanket to the spa 10 is by clamping the insulation blanket 30 between the spa rim 12*a* and the skirt panel 16, this requires the skirt panel 16 to fit tightly up under the rim as per FIGS. 1 and 3. Since the skirt panel 16 is not designed to be load bearing, there is no necessity that it be of a vertical height equal to the distance between rim 12*a* and the floor F, upon which spa 10 rests. However, as the spa shell 12 is filled with water W, the spa rim 12*a* will bear down slightly on the upper edge 16*a* of each skirt panel 16. If for some reason the rim 12*a* does not bear down on the skirt panel slightly after the spa shell is filled, the insulation blanket 30 may not be clamped tightly enough to stay in place. In this case, one or more of the skirt panels 16 may be removed, and the insulation blanket stapled, or otherwise affixed into the end grain of the skirt panel 16 to hold it in proper position. Further, if necessary or desirable, any gap G' left between the foil side of the insulation blanket 30 and the bottom surface of the rim 12*a* may be filled by an appropriate insulation barrier to prevent convection heat loss flowing along the underside of the spa shell rim 12*a*. FIG. 1 shows such a staple at 106, whose legs 106*a* pass through the insulation blanket where it rides over the upper edge or end face 16*a* of the skirt panel 16. The legs 106*a* penetrate into the skirt panel sufficiently to maintain the peripheral edge of the insulation blanket fixed to the skirt panel 16 sealing off dead air space 26, assuming that the mass of water W within the spa shell well 62 is insufficient to press the rim 12*a* of the spa shell against the insulation blanket and thereby sandwiching the peripheral portion of the insulation blanket 30 with sufficient pressure to maintain the mounting of the insulation blanket to the spa 10.

The insulation and method of installation as described above with respect to the first embodiment of the invention, FIGS. 1–3, details the preferred installation of the insulation blanket 30 to knock down or portable spa. Such design is easily movable due to the fact that the skirt panels 16 are not permanently attached to the spa shell 12. With the insulation blanket compressed between the top or edge 16*a* of the skirt panel 16 and the underside of the spa rim 12*a* to hold it in place, there is no need for staples 106. Most of the spas sold are of the knock down design, and thus the method of securing the insulation blanket 30 as described above will most commonly be employed.

Figure 4:
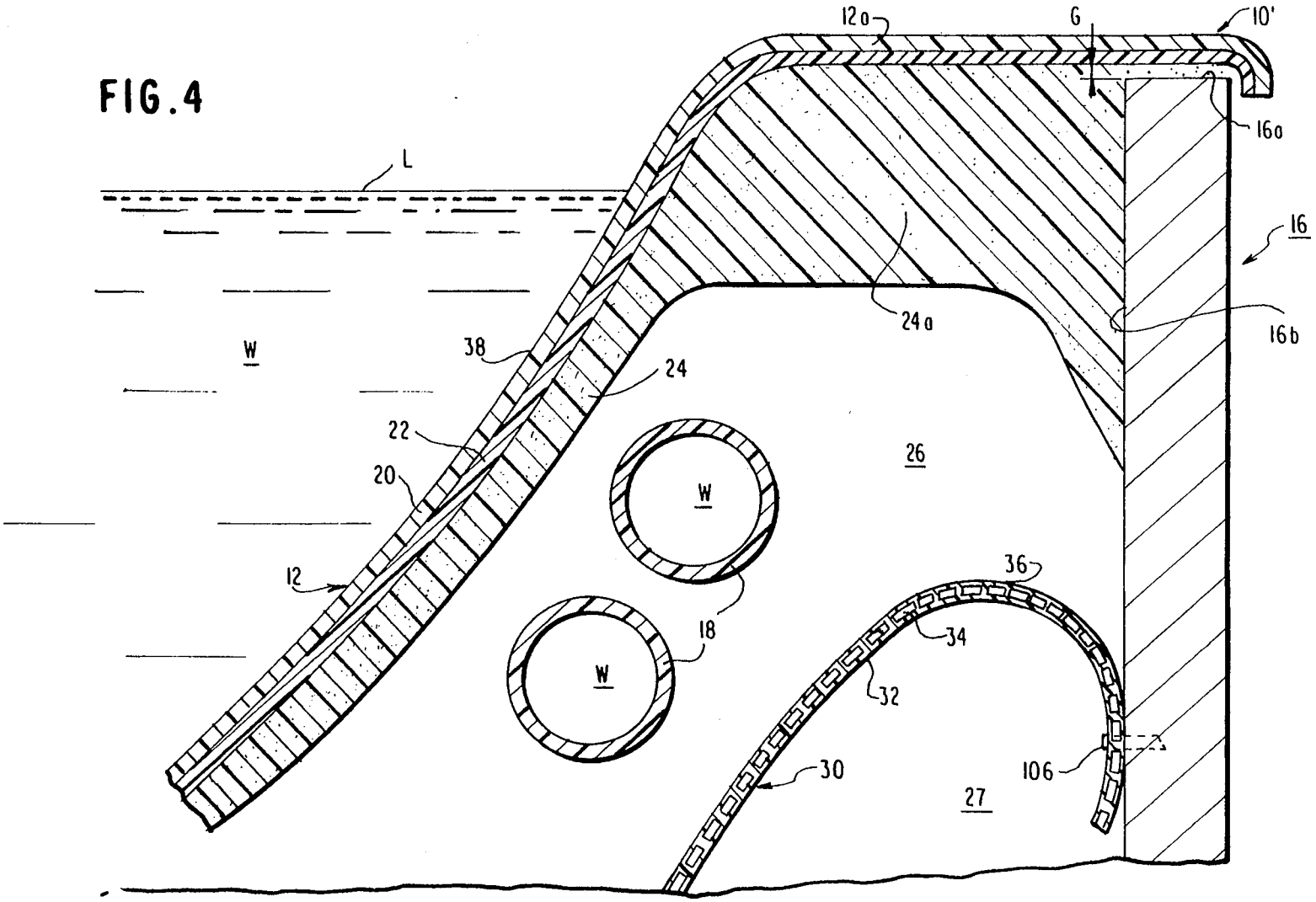
FIG. 4 is an enlarged, transverse sectional view of an alternative insulation blanket installation method for a one-piece spa forming a second embodiment of the invention.

Occasionally, spas and hot tubs are sold as unitary structures, i.e. treated as one piece units, FIG. 4. With such unitary structure designed, the skirt panels 16 are fastened together at the factory and permanently attached to the spa shell via urethane foam, which further acts as a thermal insulation barrier to assist in limiting the escape of heat from the water W within the well of the spa shell 12, as well as heat from the uninsulated PVC tubing 18 within which the warm water circulates to and from the spa shell interior and the spa support equipment 94.

As may be appreciated, in the embodiment of FIG. 1, in addition to a dead air space 26 being created between the insulation blanket 30 and the urethane foam insulation covered spa shell 12, there is a further dead air space created between the internal surface 16*b* of the skirt panel 16 and the insulation blanket. Some convection flow occurs due to the progressive heating of the air in contact with the white side layer 32 of the insulation blanket 30. The heated air rises to the top of the dead air space 27 as indicated by arrows 108, and then moves down in contact with the cooler wood wall or skirt panel 16 as indicated by arrows 110.

FIG. 4 shows a second embodiment of the invention, wherein like elements have like numerical designations.

The same elements make up the insulated spa 10' of FIG. 4, essentially a spa shell 12, a vertical wood wall or skirt panel 16, and the insulation blanket 30. In this embodiment, contrary to the method of manufacture and the insulated spa resulting from such manufacture in accordance with drawing FIGS. 1–3, the urethane foam insulation layer 24 is extended and indeed thickened in the vicinity of the rim 12*a* of the spa shell 12. Further, the urethane insulation layer 24 extends to fill the gap G between the top 16*a* of the wood wall or skirt panel 16 and forms an integrated thermal insulation barrier extending from the spa shell 12 below the water level L of the water filling the spa 10' and the skirt panel 16. As may be appreciated, the same warm water circulation tubes of PVC as at 18 are provided at the same locations. As a result, an alternate method for attaching the insulation blanket is required. Preferably, with the spa shell 16 and skirt assembly upside down, the insulation blanket 30 is spread out over the spa shell with the foil side 38 of the insulation blanket 30 facing towards the urethane foam insulation layer 24 of the spa shell 12. The blanket is then brought up along the inside of the skirt panels 16 on all sides of the spa 10' and is stapled to the inside surface 16*b* of the skirt panels 16 as at 106 adjacent the thickened area of the urethane foam insulation layer as at 24*a*.

Similar to the first embodiment, the excess insulation blanket material is then trimmed off, although it may not necessarily be so, since it occupies a portion of the dead air space 27 on the white side 32 of the insulation blanket 30. Since the product is to be shipped and sold as a finished unitary structure, all procedures may be done at the factory. The staples 106 should be placed 2 to 3 inches apart along the edge of the insulation blanket 30 to provide an airtight seal. The plumbing connections and support pack control connections such as those associated with air lines 80 must be brought out through slits 21 of appropriate size in the insulation blanket 30 in the appropriate places. In similar fashion to FIG. 3, the slits 21 within the insulation blanket 30 and the pieces of foil tape 19 sealing off the plumbing connections and support pack control connections at 4, the PVC tubes 18 or air lines 80 or their equivalent, are effected in this embodiment. In all other respects, the embodiment of FIG. 4 is effected in the same manner as that described with respect to the first embodiment, FIGS. 1–3, and the resulting insulated spa structure is of identical construction.

As may be appreciated, the invention may be embodied in other specific forms without departing from the spirit or essential characteristics as discussed in detail with respect to the two illustrated embodiments. The present embodiments are therefore considered in all respects as being illustrative only and non-restrictive, and the scope of the invention is provided by the appendant claims rather than by the foregoing description, and all changes which come within the meaning and the range of equivalency of the claims are therefore intended to be embraced therein.

What is claimed is:

1. Method of thermally insulating a spa, said spa comprising:

a generally U-shaped, upwardly open spa shell having a bottom an exterior, an interior, and an integral rim about a periphery thereof;

wood skirt panels adapted to fit up under said integral rim of the spa shell; and plumbing connections on said exterior of said spa shell including warm water circulating tubing projecting outwardly of an exterior surface of the spa shell, said method comprising:

preparing an insulation blanket having orthogonal dimensions sized larger than orthogonal dimensions of said spa shell and having a heat reflective metal foil on one side thereof;

placing said spa shell on top of said insulation blanket with said metal foil heat reflective surface of said blanket facing the exterior of said spa shell;

installing said wood skirt panels about the exterior of said spa shell with a periphery of said insulation blanket sandwiched between an underside of said spa rim and a top edge of the wood skirt panels and retaining said insulation blanket in a loose bag like fashion around the spa shell;

forming openings locally in the insulation blanket in a vicinity of said tubings to allow said tubing to pass through said blanket openings and sealing the blanket about the tubing, with the tubing passing through said blanket openings to create a dead air space of significant magnitude between the spa shell and the blanket to prevent convection air currents created along the exterior of the spa shell and across the tubing containing warm water from escaping to the atmosphere outside of the dead air space, thereby significantly reducing heat loss by convection, with the blanket heat reflective metal foil facing the spa shell reflecting radiant heat back towards the spa shell and reducing loss of radiant heat to the outside of the spa.

2. The method as claimed in claim 1, wherein said insulation blanket is spread on an area of a floor, the U-shaped spa shell has a foot well, and wooden shims are installed between said foot well of the spa and said insulation blanket to level the spa shell prior to the step of installing said wood skirt panels.

3. The method as claimed in claim 2, wherein the step of levelling of the spa comprises installing the shims between the bottom of the foot well and the insulation blanket after the spa shell has been placed on the blanket in contact with the metal foil heat reflective surface.

4. The method as claimed in claim 1, further comprising the step of stapling the periphery of the insulation blanket to a top edge of the skirt panels at several positions along each skirt panel to facilitate installation of the insulation blanket prior to placing of the upper edge of the skirt panels under the spa shell rim.

5. The method as claimed in claim 1, wherein said step of sandwiching the periphery of the blanket between the underside of the spa rim and the top edge of the wood skirt panels comprises folding of the blanket up and over the spa shell rim and into the interior of the spa shell along all sides of the spa, leaving a reasonable amount of excess insulation material of the blanket below the rim, installing said skirt panels by tucking the top edge of the skirt panels under the spa rim in contact with the periphery of the blanket and setting the skirt panels vertical to cause the periphery of the blanket to be sandwiched between the top edge of the skirt panels and the bottom of the spa shell rim.

6. The method as claimed in claim 5, further comprising the step of the fastening the skirt panels together and trimming off a content of the insulation blanket extending to the exterior of the spa beyond the skirt.

7. The method as claimed in claim 5, further comprising a step of pulling the periphery of the blanket inwardly between the top edge of the skirt panels and the spa shell rim to create said excess of blanket material below the rim for subsequent use if the skirt panel is removed.

8. The method as claimed in claim 5, wherein said step of forming openings in said blanket comprises cutting of slits into the insulation blanket locally in an area of the plumbing connections to permit the warm water tubing to pass through the blanket slits, and taping of the blanket about the periphery of the tubing to seal off the slits to maintain the dead air space.

9. The method as claimed in claim 5, wherein said insulation blanket comprises at least one thin flexible plastic sheet having said heat reflective metal foil on one side of said at least one thin flexible plastic sheet, and said step of applying said insulation blanket to the exterior of said spa shell comprises applying the at least one thin flexible plastic sheet with said heat reflective metal foil facing said spa shell.

10. The method as claimed in claim 5, wherein said insulation blanket is constituted by a multilayer flexible plastic assembly heat sealed locally to form a plurality of juxtaposed small dead air spaces and constituting a bubble pack and having a heat reflective metal foil on one side thereof, and said step of applying the insulation blanket to the exterior of the spa shell comprises applying said bubble pack to said spa shell, with said heat reflective metal foil facing the exterior of the spa shell.

11. The method as claimed in claim 1, wherein said step of preparing an insulation blanket comprises positioning a plurality of similarly sized lengths of flexible plastic sheet material of similar width side-by-side and applying tape evenly across the abutting edges of said side-by-side flexible plastic sheet material lengths to form said insulation blanket having orthogonal dimensions in excess of the orthogonal dimensions of the spa shell to be covered by the insulation blanket.

12. Method of thermally insulating a one-piece space, said spa comprising:

a generally U-shaped, upwardly open spa shell having an exterior, an interior and an integral rim about the periphery thereof;

wood skirt panels adapted to fit up under the integral rim of the spa shell, and plumbing connections on the exterior of the spa shell including warm water circulating tubing projecting outwardly of the exterior surface of the spa shell, said method comprising assembling skirt panels about spa shell and bonding said spa shell and wood skirt panels into an integral unit by applying urethane foam to the exterior of the spa shell, with a top edge of the wood skirt panel inserted beneath the spa shell rim and fastening a periphery of the insulation blanket to an inside surface of the skirt panel below said rim with staples, thereby enclosing the underside of the exterior of the spa shell and the connecting plumbing in a loose bag formed by said insulation blanket and defining a dead air space therebetween.

* * * * *